US005104724A

United States Patent [19]

Hsu

[11] Patent Number: 5,104,724

[45] Date of Patent: Apr. 14, 1992

[54] DRYER FABRIC

[75] Inventor: Chien-Yen Hsu, Greer, S.C.

[73] Assignee: Wangner Systems Corporation, Greenville, S.C.

[21] Appl. No.: 712,056

[22] Filed: Jun. 7, 1991

[51] Int. Cl.[5] ..... D03D 13/00

[52] U.S. Cl. ..... 428/222; 34/116; 34/123; 162/358; 162/DIG. 1; 139/383 A; 428/223; 428/257; 428/258

[58] Field of Search ..... 139/383 A; 162/358, 162/DIG. 1; 428/222, 223, 257, 258; 34/116, 123

[56] References Cited

U.S. PATENT DOCUMENTS 4,345,730 8/1982 Leuvelink ..... 428/222
4,346,138 2/1982 Lefferts ..... 428/222
4,381,612 5/1983 Shantz ..... 34/123
4,392,902 7/1983 Lefferts ..... 428/222
4,490,925 1/1985 Smith ..... 34/123
4,500,590 2/1985 Smith ..... 428/222
4,583,302 4/1986 Smith ..... 34/116
4,755,420 7/1988 Baker et al. ..... 139/383 A

*Primary Examiner*—James J. Bell
*Attorney, Agent, or Firm*—Cort Flint

[57] ABSTRACT

The invention is directed to a dryer section of a papermaking machine comprising between 10 and 20 cylinders in with each of the cylinders is gas fired to have an operating temperature of between 500° F. and 700° F. A dryer fabric operating with these cylinders capable of withstanding the above temperatures. The fabric is of coil construction of porosity of between 600 and 1000 CFM. The yarn forming the fabric is a monofilament formed of PEEK.

13 Claims, 2 Drawing Sheets

DRYER FABRIC

BACKGROUND OF THE INVENTION

The invention relates to a dryer fabric for use in a gas heated dryer section of a papermaking machine.

A conventional papermaking machine typically includes a forming section, a press section, and a dryer section wherein the pulp is progressively formed and dried into paper. The different papermaking machine sections require different kinds of papermaking fabric to support and carry the pulp or paper through the particular section. In the dryer section of the papermaking machine, the ability of the dryer fabric to handle water and heat on the machine is of the utmost importance. Typically, fabrics in the dryer section have included woven fabrics or spiral fabrics. These fabrics must be capable of withstanding high temperatures and steam without breaking down. The dryer section includes a number of heated rollers or cylinders. One of the functions of the dryer fabric is to hold the wet paper against the heated cylinder to achieve the dryness desired.

Spiral fabrics which include elongated strips of spirals intermeshing and joined together with pintles are utilized in the dryer section of papermaking machines. For example, spiral papermaking fabrics are disclosed in U.S. Pat. Nos. 4,346,138, 4,381,612, 4,392,902, 4,490,925, and 4,755,420.

Woven fabrics used in the dryer section are generally two-ply fabrics with a low warp and weft count. This is necessary in order to achieve a sufficient openness for proper drainage.

The heated cylinders of the conventional dryer section are typically heated by steam introduced into the interior of the cylinders. The operating temperatures are in the range of 350° F.

Recent developments in paper making machinery have introduced in the dryer section gas heated cylinders. The advantages of gas heated cylinders over the conventional steam heated cylinders are many.

Gas heat enables the cylinders to be heated to as much as 700° F. The additional heat makes it possible for fewer cylinders to perform the dying operation. As many as 80% fewer cylinders may be used; i.e. from the normal 40–80 cylinders to as few as 8–20. This allows for an increase in production and requires less dryer fabric.

The predominant material for dryer fabrics has been polyester. Unfortunately, polyester melts at 500° F. Fiberglass monofilaments wrapped with acrylic yarns have also been used to form dryer fabrics. They also, to a large extent, have been found to be unsatisfactory because the acrylic cannot withstand the higher temperatures.

Monofilaments formed from polyphenylene sulphide (PPS) or a blend of PPS and polyamide 66 have also been used to form dryer fabrics. See U.S. Pat. No. 4,755,420. These monofilaments also have the draw back that they cannot withstand the higher temperatures.

U.S. Pat. No. 4,359,501 recognizes the hydrolysis resistance qualities of polyetheretherkotone monofilaments operating at elevated temperatures of up to 500° F. This is a maximum upper temperature for operating with the usual steam heated dryer operation. The patent is restricted to a woven dryer fabric which has a maximum permeability of 600 CFM (cubic feet of air per minute). Above 600 CFM woven fabrics become extremely unstable and sleazy and are not suitable as dryer fabrics. Woven fabrics in the range of 600 CFM do not present a smooth support surface and have a tendency to mark the paper product.

It is an object of this invention to provide a dryer section of no more than twenty cylinders with a continuous coil dryer fabric having superior degradation properties.

It is an object of this invention is to produce a coil dryer fabric with superior degradation properties and superior stability properties when exposed to prolonged use under temperatures in the range of 500° F. to 700° F.

Another object of this invention is to produce a coil dryer fabric using monofilaments having superior toughness and sufficient flexibility so as to not sustain degradation during a drying operation at temperatures over 500° F.

Another object of this invention is to produce a coil dryer fabric for use with a gas heated dryer section having no more than twenty cylinders.

Another object of this invention is to produce a coil dryer fabric of PEEK monofilaments shaped to have a rectangular cross-section and a permeability of between 600–1000 CFM.

Another object of this invention is to produce a coil dryer fabric from PEEK monofilaments shaped to have a circular cross-section and a permeability of between 600–1000 CFM.

Another object of this invention is to produce a coil dryer fabric in which the pintle forming monofilament of PEEK is configured.

SUMMARY OF THE INVENTION

A coil dryer fabric for use in a gas heated dryer section of a paper making machine having fewer than twenty cylinders which operate at between 500° F. and 700° F. The fabric is comprised of machine direction yarns and cross machine direction monofilament yarns formed of PEEK. The monofilament machine direction yarns are configured into coils and the cross machine direction yarns comprise configured coil connecting pintles. The machine direction yarns may be circular in cross section or rectangular in cross section. The yarns' diameter ranges between 0.5 mm and 0.9 mm. One of the machine direction and cross machine direction yarns may be of a smaller diameter than the other. A papermaking machine is disclosed in which the dryer section comprises no more than twenty cylinders which operates at temperatures ranging between 500° F. and 700° F. A dryer fabric formed of PEEK monofilament yarns is capable of withstanding temperatures up to 700° F. arranged about the cylinders. The fabric is of coil construction, has a permeability factor of between 600 and 1000 CFM and has been heat set at between 500° F. and 550° F.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DESCRIPTION OF A PREFERRED EMBODIMENT

The usual dryer section consists of approximately forty to eighty cylinders which are heated with steam under pressure to operate at approximately 350° F. This arrangement, of course, requires a dryer fabric of sufficient length to traverse these forty cylinders.

The dryer section of the invention reduces the number of cylinders of the above arrangement by approximately 80%. The instant dryer section operates with between four and twenty cylinders which are gas heated up to 700° F. At the present time the most desirable operating temperature is 550° F.

Figure 1:
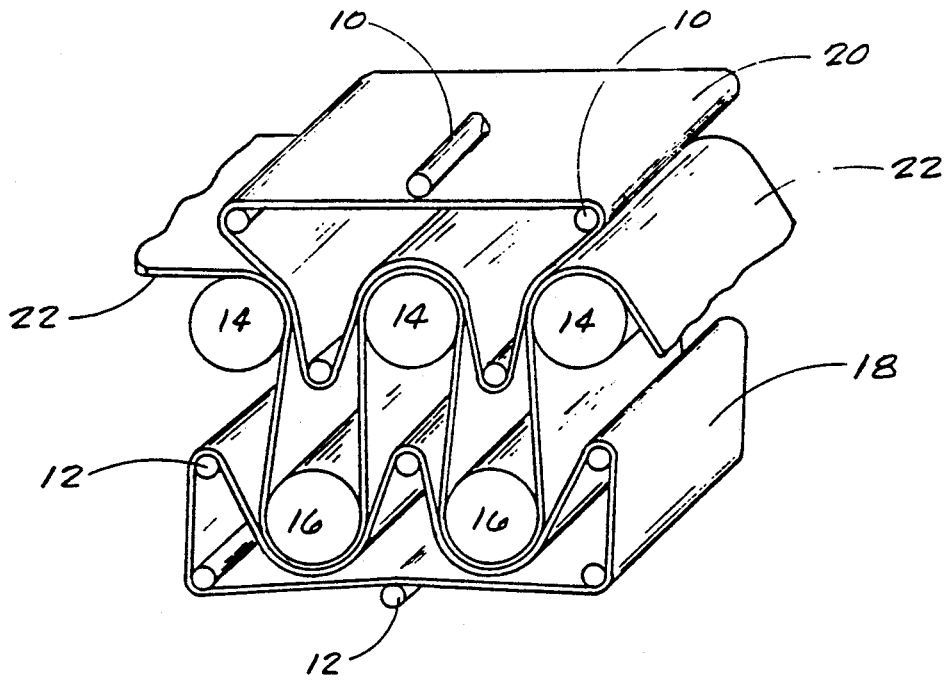
FIG. 1 is a partially diagrammatic perspective view of a dryer section of a paper machine.

Referring to FIG. 1, there is shown a portion of the dryer section of a paper machine according to the invention. The dryer section consists of upper and lower idler rolls 10 and 12 and heated cylinders or drums 14 and 16. Dryer fabric 18 passes over idler rollers 12 and beneath drums 16 while dryer fabric 20 passes over idler rollers 10 and above drums 14. The dryer fabrics are arranged so that the web of wet paper 22 passes between cylinders 14 or 16 and dryer fabrics 18 or 20 so as to be held tightly against the cylinders during the process.

The paper forming material or slurry received onto the dryer fabric is between 40% to 50% solid material. When it leaves the dryer fabric after passing no more than twenty cylinders, the solid content has been increased to approximately 98%. It can readily be seen that a tremendous amount of water is removed in a very short time. This requires that the dryer fabric have a very high permeability factor of between 600 and 1000 CFM. The preferred CFM is 800.

Because of the limited area in which the drying operation takes place, the steam build up is quite high. A high hydrolysis resistance is, therefore, necessary of the dryer fabric.

Figure 2:
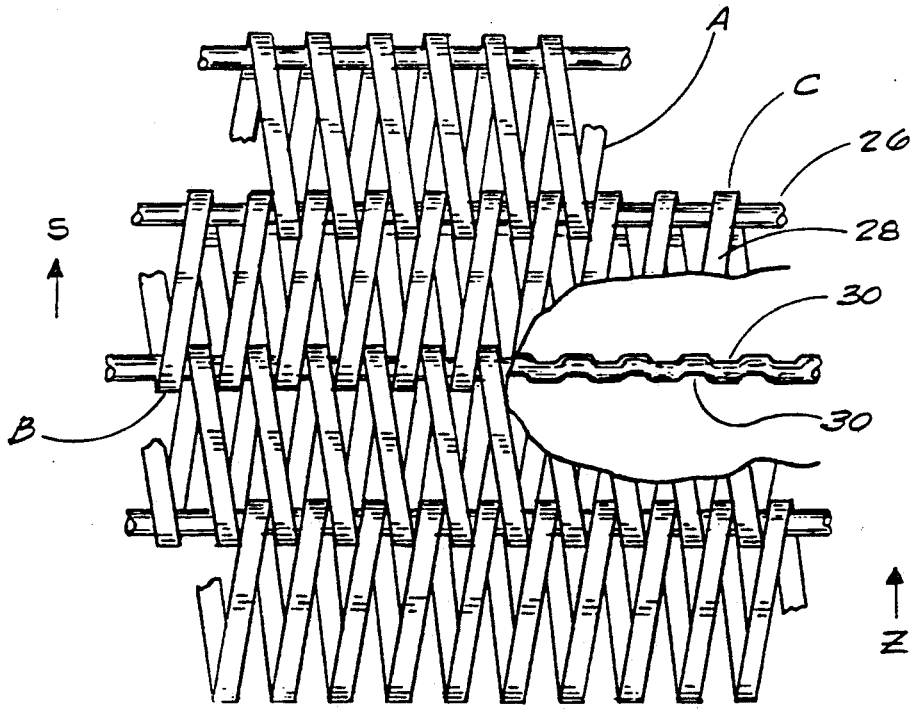
FIG. 2 is an enlarged sectional view of a spiral dryer fabric with rectangular shaped monofilaments forming the spirals.

A spiral construction dryer fabric, such as shown in FIG. 2, is necessary for use here because it provides the openness or permeability capability and at the same time is a very stable fabric having good runability.

Figure 3:
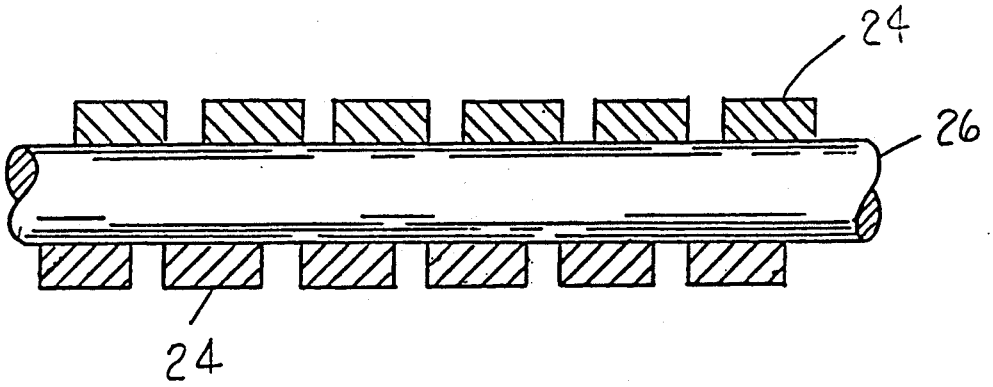
FIG. 3 is a sectional view along lines 2—2 of FIG. 2.
Figure 4:
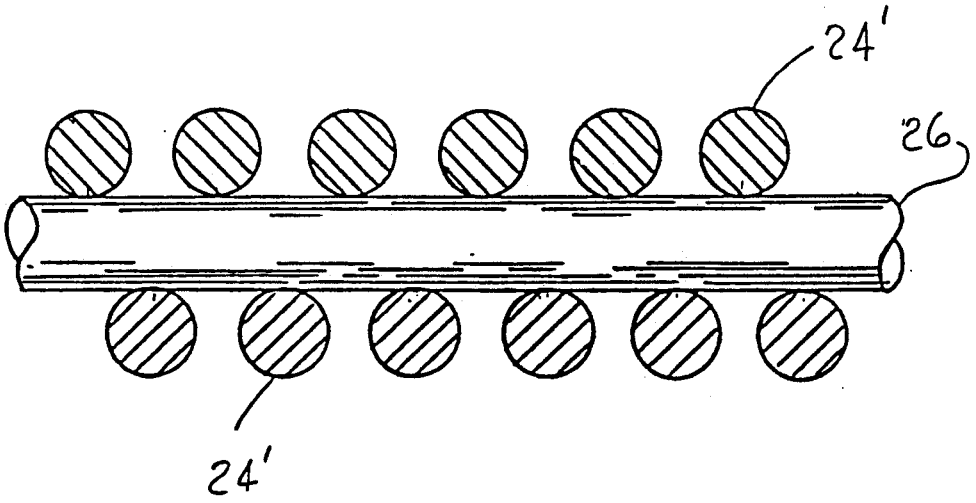
FIG. 4 is a sectional view similar to FIG. 3 wherein the coils are formed of filaments having a circular cross-section.

The fabric of FIGS. 2–4 consist of monofilaments 24 or 24' formed of PEEK which have been shaped into spiral coils A. The coils are wound in an oblong circular pattern and are interconnected at opposite ends B and C with pintles or hinge pins 26. Pintles 26 extend transverse the machine direction of the fabric while the elongate portions 28 of the spiraled monofilament extend in the machine direction. As seen in FIG. 2, adjacent coils are coiled in opposite directions with a first row of coils formed by coiling the monofilament in the "Z" direction and the adjacent rows of coils formed by coiling the monofilament in the "S" direction. Pins 26 are formed also of PEEK.

The coil fabric at this point is extremely unstable and sleazy. The coils have a tendency to slip transversely of the pintles. In order to overcome this problem and stabilize the fabric, the pintles 26 must be configured or crimped as at 30 so that ends B and C of coils A are retained from transverse movement. As can be seen in FIG. 2, a crimp 30 appears on opposing sides of each pintle 26 so that all coils are stabilized. A crimp of between 6% and 15% at each of these points across the pintle has proven to be satisfactory. The most desirable crimp is 10%.

In order to impart the necessary crimp in pintles 26, the fabric is placed under longitudinal tension at an elevated temperature. Due to the thermal characteristics of PEEK, it is necessary to heat the fabric to a temperature of between 475° F. and 550° F. while applying a longitudinal force of between 40 PLI and 60 PLI (pounds per linear inch). The temperature and force selected to heat set the fabric is dependent upon the percent crimp desired.

The heat setting process acts to not only produce crimps longitudinally of the pins 26, it also acts to reconfigure the coils from a substantially circular configuration into a substantially oval configuration. This produces the elongate flat areas 28 which provide a smooth support surface for the paper product.

The monofilament selected to form the fabric of the invention must be able to retain its strength under prolonged conditions of extreme temperatures in the range of 550° F. to 700° F. and under moist conditions. The monofilament must have excellent wear characteristics and hydrolysis resistance. PEEK monofilaments which are an ICI resin and are produced by Shakespeare possesses these characteristics.

The monofilament for use with the coil fabric of FIG. 2 may be extruded to have a rectangular cross-section as shown at 24 in FIG. 3, or a circular cross-section as shown at 24' in FIG. 3. The usual diameters of a rectangular shaped monofilament are a major axis measurement within the range of 0.3 mm to 1.3 mm and a flatness ratio of 1.1:1 and 2.5:1. The usual dimensions for a circular monofilament is between 0.4 mm and 1 mm.

While a preferred embodiment of the invention has been described using specific terms, such description is for illustrative purposes only, and it is to be understood that changes and variations may be made without departing from the spirit or scope of the following claims.

What is claimed is:

1. A dryer fabric of coil construction for use in a dryer section having fewer than twenty gas heated cylinders which operate at between 500° F. and 700° F.;

said fabric consisting of a plurality of coiled monofilaments having engaging monofilament pintles disposed through opposite ends thereof;

said coiled monofilaments are arranged to extend in a machine direction and said pintles are arranged to extend in a cross-machine direction;

said monofilaments are formed of PEEK; and said fabric has a porosity of between 600 and 1000 CFM.

2. The dryer fabric of claim 1 wherein at least one of the machine direction and cross machine direction yarns are circular in cross section.

3. The dryer fabric of claim 1 wherein at least one of the machine direction and cross machine direction yarns are rectangular in cross section.

4. The dryer fabric of claim 1 wherein the machine and cross machine yarns are between 0.5 mm and 0.9 mm in diameter.

5. The dryer fabric of claim 4 wherein one of the machine direction and cross machine direction yarns is of a smaller diameter than the other of said yarns.

6. The dryer fabric of claim 4 wherein the cross machine yarns have a plurality of longitudinally spaced crimps of at least 6% which act to stabilize said fabric.

7. The dryer fabric of claim 4 wherein said crimps appear alternately on opposite sides of said cross machine yarns.

8. The dryer fabric of claim 1 wherein said fabric is heat set at between 500° F. and 550° F.

9. In a papermaking machine:

a dryer section comprising no more than twenty cylinders;

said cylinders having an operating temperature of between 500° F. and 700° F.;

a dryer fabric of coil construction having a porosity of between 600 and 1000 CFM and capable of withstanding temperatures up to 700° F. arranged about said cylinders;

said fabric being formed of PEEK monofilament yarns.

10. The dryer section of claim 9 wherein the number of cylinders is ten.

11. The dryer section of claim 9 wherein the cylinders are gas fired.

12. The dryer section of claim 9 wherein the coil forming monofilament yarns have a rectangular cross-section and a major axis of between 0.3 mm and 1.3 mm.

13. The dryer section of claim 9 wherein the monofilament yarns have a diameter of between 0.4 mm and 1.0 mm.

* * * * *